United States Patent [19]

Yamakawa et al.

[11] Patent Number: 4,883,234

[45] Date of Patent: Nov. 28, 1989

[54] CASSETTE WITH WINDING SLACK PREVENTING MECHANISM

[75] Inventors: Noboru Yamakawa, Nara; Mineo Yamauchi, Kyoto, both of Japan

[73] Assignee: Dai Nippon Insatsu Kabushiki Kaisha, Japan

[21] Appl. No.: 259,593

[22] Filed: Oct. 19, 1988

[30] Foreign Application Priority Data

Oct. 19, 1987 [JP] Japan ..... 62-158795[U]

[51] Int. Cl.[4] ..... B65H 18/10

[52] U.S. Cl. ..... 242/67.3 R; 242/198

[58] Field of Search ..... 242/67.3 R, 198, 75.4, 242/71.1, 71.2

[56] References Cited

U.S. PATENT DOCUMENTS

| | | | |
|---|---|---|---|
| 4,033,523 | 7/1977 | Roman | 242/198 |
| 4,210,296 | 7/1980 | Frechette | 242/198 |
| 4,605,325 | 8/1986 | Hofmann | 242/198 X |
| 4,687,358 | 8/1987 | Saitou | 242/198 X |
| 4,736,903 | 4/1988 | Landry et al. | 242/198 |

FOREIGN PATENT DOCUMENTS 61-152475 7/1986 Japan .

*Primary Examiner*—John M. Jillions

*Attorney, Agent, or Firm*—Arnold, White & Durkee

[57] ABSTRACT

Reels for carrying a sheet-like medium wound thereon are provided in parallel relation in a cassette case in a manner rotatable and shiftable longitudinally of the reels. A reel-biasing leaf-spring assembly is provided adjacent to one longitudinal end of each reel to bias the reel in a longitudinal direction. The leaf-spring assembly has a leaf-spring portion exerting the biasing force to the reel via an end projection on the reel, and rotation preventing arm angularly extending from the leaf-spring portion to normally engage a rotation preventing stub shaft carrying said projection thereon, the stub shaft having thereabout a plurality of flat outer surfaces one of which is engaged by said rotation preventing arm, whereby the reel is prevented from rotation. When the cassette is fitted in a printer, for example, the reel is shifted longitudinally against the force of the leaf-spring assembly, and the rotation preventing arm is moved away from the stub shaft so that the reel is allowed to rotate. The prevention of rotation is effective to eliminate unintentional slackening of the sheet-like medium.

5 Claims, 2 Drawing Sheets

CASSETTE WITH WINDING SLACK PREVENTING MECHANISM

BACKGROUND OF THE INVENTION

The present invention relates to a cassette containing a sheet- or strip-like medium and, more particularly, to a cassette with a mechanism for preventing the slackening of the sheet- or film-like medium.

There have been long used cassettes of the type in which two reels are rotatably mounted in parallel with each other in the cassette case so that a sheet- or strip-like medium is unwound from one reel and then wound around the other reel. In the case of such cassettes of the type described above, it is preferable to provide a mechanism for preventing the rotation of reels in order to prevent the slackening of the wound medium when the cassettes are not used. For instance, such mechanism is disclosed in Japanese Laid-Open Patent Application (Kokai) No. Sho-61-152,475. In this mechanism, springs are mounted within the cassette case such that they normally bias the reel only in one axial direction thereof so as to engage a projection extended from one end face of each reel with an engaging recess formed in the side wall of the cassette case in opposed relationship with the projection, thereby preventing the rotation of the reel.

However, in this cassette, one side wall of the cassette case must be formed with an engaging recess or projection for engagement with an engaging projection or recess of the reel so that there arises the problem that the fabrication costs of the cassettes increase.

The present invention was made to substantially solve the above and other problems encountered in the conventional cassettes and has for its object to provide a cassette capable of preventing the rotation of reels without forming one or more projections or recesses for preventing the rotation of the reels in the cassette case itself.

To the above and other ends, according to the present invention, in a cassette of the type in which reels carrying a sheet-like medium wound there around are rotatably mounted in a cassette case in such a manner that the reels are movable in their longitudinal directions, a winding slack preventing mechanism is provided which comprises: rotation preventing means extending axially outwardly of one end of at least one of the reels; a projection on said rotation preventing means, extending axially outwardly; said rotation preventing means and said projection being disposed within a space defined in said cassette case; and a reel-biasing leaf-spring assembly provided in said space to bias the reel longitudinally thereof in a direction opposite to the direction in which said projection projects, said leaf-spring assembly being in contact with said projection for biasing the reel and having on the distal end thereof a rotation preventing arm disposed adjacent to, and normally engaging said rotation preventing means to prevent the rotation of the reel, said leaf-spring assembly being so designed and constructed that when the reel is pushed in the direction opposite to the direction in which said leaf-spring assembly imparts the biasing force so that said leaf-spring assembly is deformed, said rotation preventing arm is moved away from said rotation preventing means, thereby to allow the reel to rotate.

DESCRIPTION OF THE PREFERRED EMBODIMENTS

Preferred embodiments of the present invention will now be described with reference to the accompanying drawings illustrating a transfer printing film storage cassette used in the heat-sensitive-transfer printers, but it is to be understood that the present invention is not limited to such a transfer printing film storage cassette and can be equally applied to any cassettes containing any sheet-like media.

Figure 1A:
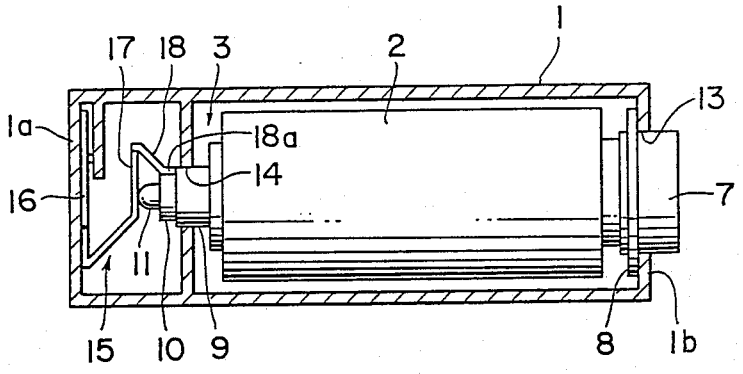
FIG. 1A is a sectional view of a preferred embodiment of a cassette in accordance with the present invention, illustrating a state in which the cassette is not inserted into a printer.
Figure 1B:
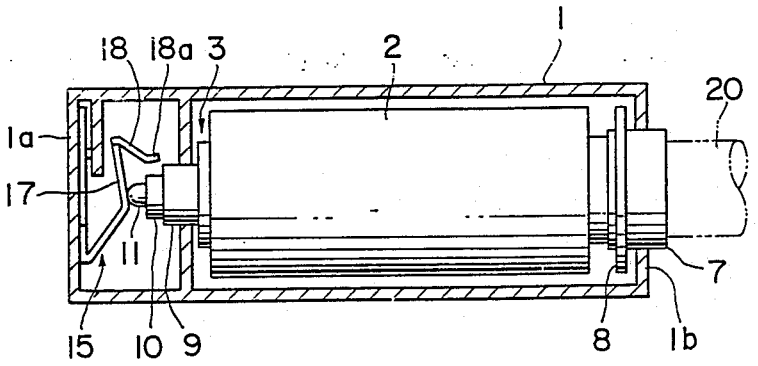
FIG. 1B is a view similar to FIG. 1A but illustrating a state in which the cassette is inserted into the printer.
Figure 2:
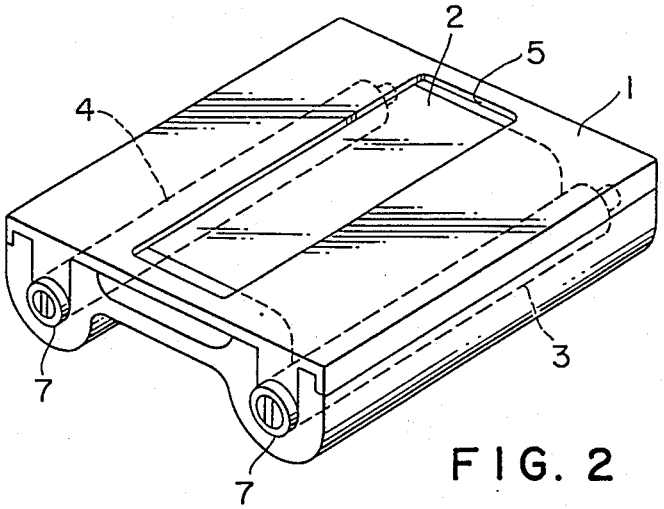
FIG. 2 is a perspective view of the preferred embodiment of the present invention.

FIG. 2 is a schematic perspective view of a preferred embodiment of a cassette in accordance with the present invention and FIGS. 1A and 1B are sectional views of a reel of the cassette shown in FIG. 2 used to explain different modes of operation thereof. In FIG. 2, reference numeral 1 represents a cassette case which contains a heat-sensitive transfer printing film 2 which is unwound from a feed reel 3 and wound around a take-up reel 4. The cassette case 1 has a window 5 through which is exposed the heat-sensitive printing film 2.

Both the reels 3 and 4 are rotatably mounted in the cassette case 1 in such a manner that they are movable in their longitudinal directions, respectively. Since the reels 3 and 4 are substantially similar in construction, only the reel 3 shown in FIG. 1A and FIG. 1B will be described in detail hereinafter. The reel 3 has a shaft 7 extending coaxially from one end (the righthand end in the figures) and a flange 8 fixed to the shaft 7. The reel 3 also has a shaft 9 extending coaxially from the other end thereof, a rotation preventing means 10 formed integral with the shaft 9 and extending outwardly from the free end thereof, and a projection 11 coaxially extending outwardly from the outer end surface of the rotation preventing means 10. The righthand shaft 7 of the reel 3 is rotatably mounted in a bearing 13 which is an opening formed through the side wall of the cassette case 1, the shaft 7 extending outwardly of the cassette case 1 for engagement with a shaft 20 (FIG. 1B) of a heat-sensitive transfer printer (not shown). On the other hand, the lefthand shaft 9 is rotatably mounted in a bearing 14 defined within the cassette case 1.

Figure 3A:
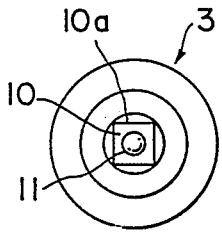
FIGS. 3A, 3B and 3C are end views of reels, respectively, used in the cassette shown in FIGS. 1A, 1B and 2, illustrating different constructions, respectively, of rotation preventing means.
Figure 3B:
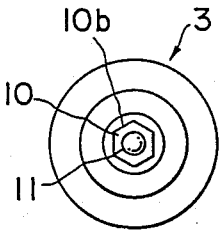
Figure 3C:
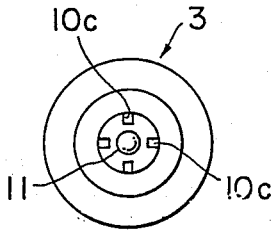

When a rotation preventing arm 18 to be described in more detail hereinafter is pressed against the outer surface of the rotation preventing means 10, the rotation of the reel 3 is interrupted. For instance, the rotation preventing means 10 may be in the form of a stub shaft which, as shown in FIG. 3A, has four flat surfaces 10*a* and a square sectional configuration, or in the form of a stub shaft which, as shown in FIG. 3B, has six flat outer surfaces 10*b* and a hexagonal cross sectional configuration, or in the form of a cylinder which, as shown in FIG. 3C, has a plurality of grooves 10*c* formed in the cylindrical outer side surface thereof for engagement with the rotation preventing arm 18.

Referring next to FIGS. 1A and 1B, a reel-biasing leaf-spring assembly 15 is disposed in the space between the projection 11 and one side wall 1*a* of the cassette case 1 in opposed relationship with the projection 11 so as to bias through the projection 11 the reel 3 in the direction opposite to the direction in which the projection 11 extends, that is to the right in FIG. 1.

Figure 4:
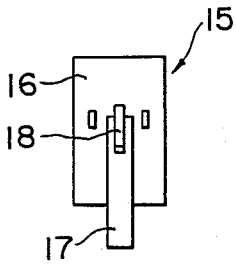
FIG. 4 is a front view of a reel-biasing leaf-spring assembly used in the cassette shown in FIGS. 1A, 1B and 2.
Figure 5:
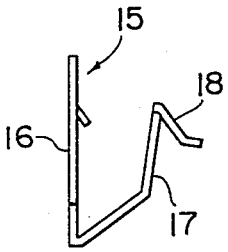
FIG. 5 is a side view thereof.

As shown in FIGS. 4 and 5, the reel-biasing leaf-spring assembly 15 comprises a mounting portion 16 which is securely joined to the cassette case 1, a leaf spring portion 17 extended slopingly from the mounting portion 16 and the above-described rotation preventing arm 18 formed at the free end of the leaf spring portion 17, whereby the leaf spring portion 17 is made into contact with the free outer end of the projection 11, thereby imparting the biasing force thereto.

Referring back to FIG. 1A, when no external force is imparted to the reel 3, the reel 3 is biased in the right direction under the force of the leaf spring portion 17 so that the reel 3 is stopped at the position at which the flange 8 of the reel 3 is in engagement with the other side wall 1*b* of the cassette case 1. In this case, the rotation preventing arm 18 is pressed against the outer surface of the rotation preventing means 10 of the reel 3 so that the rotation of the reel 3 is prevented. On the other hand, as best shown in FIG. 1B, the rotation preventing arm 18 is extended from the free end of the leaf spring portion 17 with a predetermined angle with respect thereto, so that when the reel 3 is pushed inwardly by the shaft 20 extended from the printer (not shown) such that the leaf spring portion 17 is deformed in the direction opposite to the direction in which the leaf spring portion 17 imparts the biasing force to the reel 3, the rotation preventing arm 18 is forced to move away from the outer peripheral surface of the rotation preventing means 10.

When the cassette case with the above-described construction is taken out of the printer (not shown), no external force is imparted to the reel 3 so that the reel-biasing leaf-spring assembly 15 forces the reel 3 to bias in the right direction as shown in FIG. 1A and the rotation preventing arm 18 is forcibly pressed at its distal flat engaging end 18*a* against the outer surface of the rotation preventing means 10 whereby the rotation of the reel 3 is prevented. The same is true for the reel 4. As a result, the transfer printing film is prevented from being slackened. Meanwhile, when the cassette is inserted into the printer (not shown) to a predetermined position, as shown in FIG. 1B, the righthand shaft 7 of the reel 3 engages with the shaft 20 of the printer and is pushed to the left so that the reel-biasing leaf-spring assembly 15 is deformed and the rotation preventing arm 18 is automatically moved away from the outer surface of the rotation preventing means 10. As a result, the free rotation of the reel 3 is permitted. The same is true for the reel 4. Under the above-described condition, the shaft 20 rotates the reels 3 and 4 so that the transfer printing film 2 is transported, whereby the heat-sensitive transfer printing or recording is carried out. When the cassette is taken out of the printer, the reel 3 automatically returns to the state shown in FIG. 1A so that the film is prevented from being slackened.

As described above, in the case of the cassette in accordance with the present invention, no special operation is needed in order to prevent the rotation of the reels. In other words, when the cassette is taken out of the printer or the like, the rotation of the reels can be automatically prevented whereby the slackening of the sheet-shaped medium wound around the reels can be prevented. Furthermore, when the cassette is inserted into the printer or the like, the reel-biasing leaf-spring assembly can ensure the positive interconnection between the shaft of the reel and the shaft of the printer or the like and also can prevent any play. The reel-biasing leaf-spring assembly itself has been used. However, according to the present invention, the construction of the reel-biasing leaf-spring assembly is somewhat modified such that the reel-biasing leaf-spring assembly can prevent the rotation of the reels. It therefore follows that the component parts are not increased in number; it is not needed to form one or more projections or recesses in the cassette case itself to prevent the rotation of the reels so that the cassettes in accordance with the present invention can be fabricated at less costs.

What is claimed is:

1. In a cassette of the type in which reels carrying a sheet-like medium wound there around are rotatably mounted in a cassette case in such a manner that the reels are movable in their longitudinal directions, said cassette having winding slack preventing mechanism, the improvement of said mechanism comprising:

rotation preventing means extending axially outwardly of one end of at least one of the reels;

a projection on said rotation preventing means, extending axially outwardly;

said rotation preventing means and said projection being disposed within a space defined in said cassette case; and a reel-biasing leaf-spring assembly provided in said space to bias the reel longitudinally thereof in a direction opposite to the direction in which said projection projects, said leaf-spring assembly being in contact with said projection for biasing the reel and having on the distal end thereof a rotation preventing arm disposed adjacent to, and normally engaging said rotation preventing means to prevent the rotation of the reel, said leaf-spring assembly being so designed and constructed that when the reel is pushed in the direction opposite to the direction in which said leaf-spring assembly imparts the biasing force so that said leaf-spring assembly is deformed, said rotation preventing arm is moved away from said rotation preventing means, thereby to allow the reel to rotate.

2. The improvement as claimed in claim 1 wherein said rotation preventing means is a stubshaft having a plurality of flat outer surfaces there around and said rotation preventing arm has a flat engaging end engageable with one of said flat outer surfaces.

3. The improvement as claimed in claim 1 wherein said rotation preventing means is a stub shaft having a plurality of grooves there around and said rotation preventing arm has an engaging end engageable in one of said grooves.

4. The improvement as claimed in claim 1 wherein said leaf-spring assembly comprises a mounting portion fixed to the cassette case, and a leaf spring portion extending slopingly from the mounting portion to resiliently engage said projection to exert the biasing force thereto, said rotation preventing arm extending angularly from the distal end of the leaf spring portion.

5. The improvement as claimed in claim 1 wherein said leaf-spring assebly, projection and rotation preventing means are located in a space defined within the cassette case.

* * * * *